US006478490B2

(12) United States Patent
Kelley et al.

(10) Patent No.: US 6,478,490 B2
(45) Date of Patent: Nov. 12, 2002

(54) PRINTER MEDIA TRANSPORT APPARATUS AND METHOD

(75) Inventors: Richard A Kelley, Vancouver, WA (US); Michael W Munro, Vancouver, WA (US); Ilan A Sabar, Portland, OR (US); Bruce G. Johnson, Boise, ID (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/728,034

(22) Filed: Dec. 1, 2000

(65) Prior Publication Data

US 2002/0067945 A1 Jun. 6, 2002

(51) Int. Cl.[7] ..... B41J 11/58; B41J 15/20; B65H 29/00; B65H 39/10

(52) U.S. Cl. ..... 400/624; 400/610; 400/615; 271/186; 271/303

(58) Field of Search ..... 271/186, 303; 270/58.08, 59; 400/610, 615, 605

(56) References Cited

U.S. PATENT DOCUMENTS 4,365,794 A * 12/1982 Roller ..... 271/186
5,149,217 A * 9/1992 Narita ..... 400/608.4
5,265,864 A * 11/1993 Roux et al. ..... 271/65
5,328,281 A * 7/1994 Narita et al. ..... 400/605
5,772,197 A * 6/1998 Aoki et al. ..... 270/58.08
5,887,868 A * 3/1999 Lambert et al. ..... 271/186
5,895,158 A * 4/1999 Koyabu et al. ..... 400/605
6,102,393 A * 8/2000 Kida et al. ..... 271/303
6,186,496 B1 * 2/2001 Marasco et al. ..... 271/186
6,203,001 B1 * 3/2001 Steinhilber ..... 270/59

* cited by examiner

*Primary Examiner*—Andrew H. Hirshfeld
*Assistant Examiner*—Marvin P. Crenshaw

(57) ABSTRACT

A printing apparatus with an index-feeding printing system having a first media path, a continuous feed finishing apparatus having a second media path, and a media buffer device having a third media path connecting between the first media path and the second media path. The third path may have a first portion communicating with the printing system, and a second portion communicating with the finishing apparatus, with the first and second portions merging with each other to form a common path portion terminating at a common path dead end, such that a media sheet from the printing system stops at the dead end and reverses direction for feeding to the finishing apparatus.

12 Claims, 1 Drawing Sheet

PRINTER MEDIA TRANSPORT APPARATUS AND METHOD

FIELD OF THE INVENTION

This invention relates to computer printers, and particularly to media transport mechanisms and methods.

BACKGROUND AND SUMMARY OF THE INVENTION

It is sometimes desired to process the output of computer printers with finishing devices or finishers that perform any of a range of specialized operations (e.g. hole punching, binding, cutting, folding, stapling, collating, sorting, and job offsetting.) Different users have different needs for these specialized functions. Therefore, such finishing devices are usually sold separately from printers, and are usually standardized so as to be compatible with a common printer, or with a range of printer models or brands. This permits manufacturers to affordably produce printers and finishers in adequate quantities of each model, without low-volume custom runs of particular combinations.

Most current finishers are designed to receive the output of laser printers, which are commonly used for high volume printing applications where finishers are also required. Laser printers operate in a continuous feed manner, in that the media sheet moves through the printer at an essentially smooth rate, without stopping and starting. While there is a velocity change at the outset and conclusion of printing as the sheet is picked from a supply, and deposited in an output bin, and the velocity is not necessarily perfectly constant, the motion is essentially continuous, without any intended stopping and starting. Thus, current finishers are configured to operate at similarly continuous feed rates. This permits documents to be fed sheet-by-sheet directly from the printer to an attached finisher, with the finisher having rollers that continue to move a leading portion of the sheet, even while a trailing portion of the sheet is being printed in a process that requires the position not to be disturbed.

In comparison, ink jet printers operate in a stepped or indexed manner in which a media sheet is fed in increments, stopping and starting many times during printing. The sheet must be stationary while an ink jet print head is printing a swath of ink droplets, then rapidly indexed before the next swath is begun. Existing continuous-feed finishers are unsuitable for ink jet printers because they generate alternating tension and compression in the sheet; tension while the finisher's rollers try to draw a sheet during printing of a swath, and compression as the rapid speed of the indexing exceeds the finisher's intake rate, generating resistance to indexing. These effects would act to impair printing quality by losing the feed position of the sheet during printing, and by creating rubbing by feed rollers, which impairs surface finish and print quality.

A finisher may be developed specially for indexing printers, with feed provisions for matching the feed action of the printer. However, this requires more sophisticated software and hardware connections to ensure communication, and requires stepper or closed loop DC motors in the finisher to ensure precise positional control. This is not considered practical or cost effective. Moreover, it is economically impractical to develop a separate product line and inventory of finishing devices both for continuous feed (e.g. laser) printers, and indexing or step feed (e.g. ink jet) printers. And while laser printers may generate adequate market size and demand for finishers, ink jet printer types may generate limited demand for custom suited finishers below a level considered to be economically viable.

The present invention overcomes the limitations of the prior art by providing a printing apparatus with an index-feeding printing system having a first media path, a continuous feed finishing apparatus having a second media path, and a media buffer device having a third media path connecting between the first media path and the second media path. The third path may have a first portion communicating with the printing system, and a second portion communicating with the finishing apparatus, with the first and second portions merging with each other to form a common path portion terminating at a common path dead end, such that a media sheet from the printing system stops at the dead end and reverses direction for feeding to the finishing apparatus.

DETAILED DESCRIPTION OF A PREFERRED EMBODIMENT

Figure 1:
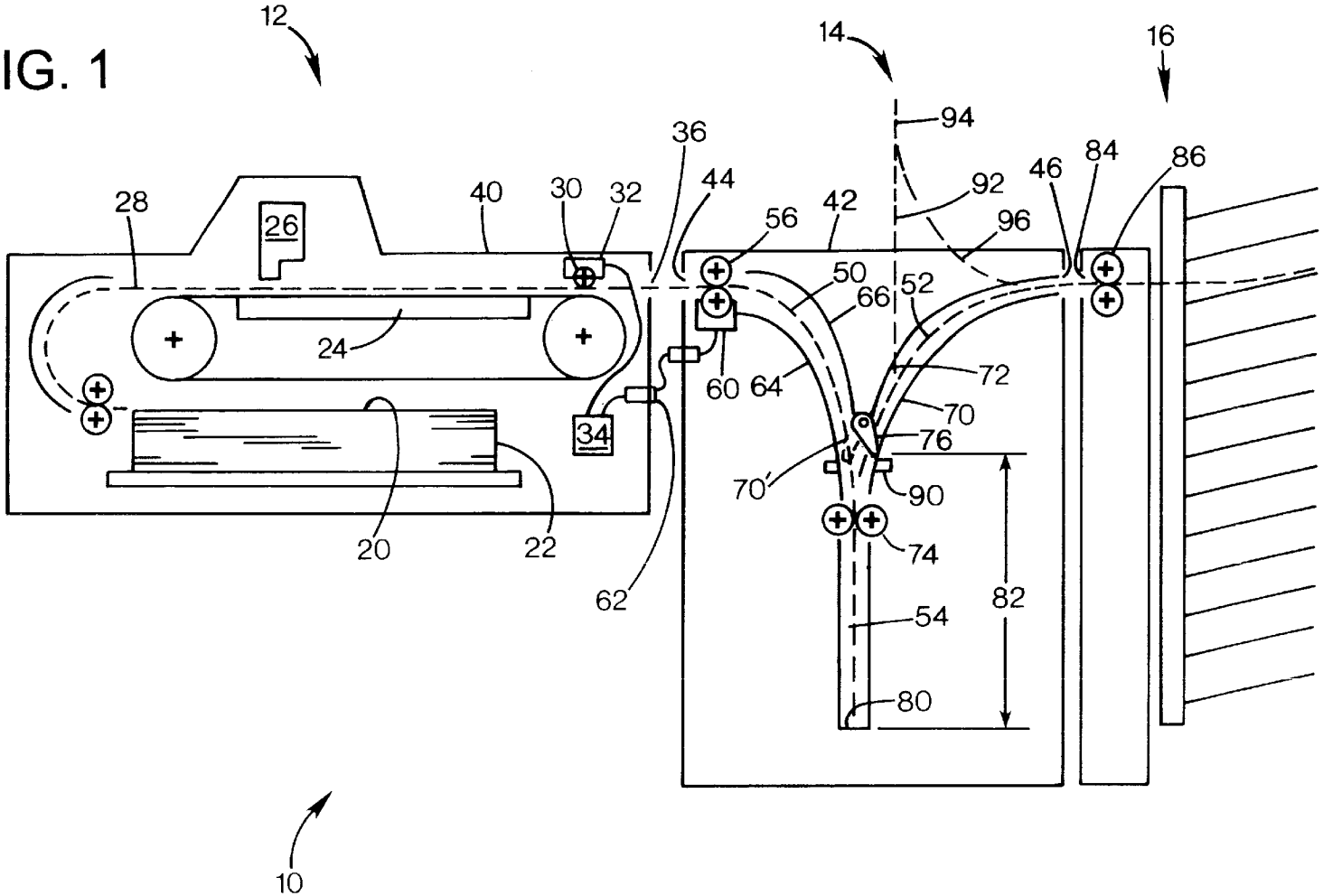
FIG. 1 is a simplified sectional side view of a printing system according to a preferred embodiment of the invention.

FIG. 1 shows a printing system 10 including a printer 12, a media buffer transport apparatus 14, and a finishing device 16. The printer is an ink jet printer that operates by drawing a sheet of media 20 from a stack 22, and transporting it over a platen 24 beneath an ink jet pen 26, which reciprocates over the sheet to generate successive swaths of an image as the sheet is incremented or indexed along a media path 28. The media is stationary during the printing of each swath, and is rapidly moved an increment between swaths. A printer output feed roller 30 is operated by a motor 32 connected to and controlled by a printer controller 34. In alternative embodiments, the output roller may freewheel, with the motor connected to the belt drive mechanism as shown, or the roller may be omitted, and other means provided to emit a printed sheet from an output aperture 36 defined in the printer housing 40.

The buffer apparatus 14 includes a housing 42 having an input aperture 44 and an output aperture 46 on opposite sides of the housing at the same level. In alternative embodiments, the apertures may be at different elevations as desired to adapt to different usage needs, and different printer and finishing devices. The buffer housing is connected to the printer housing by mechanical fasteners and alignment elements (not shown) to register the inlet aperture 44 with the outlet aperture 36 of the printer, so that the media path continues into the buffer from the printer. The media path in the buffer generally has a Y shape, with an inlet path portion 50 providing one upper arm of the Y, an outlet path portion 52 providing the other upper arm of the Y, and a common vertical path portion 54 providing the lower trunk of the Y. The upper arms of the Y splay outward as their free ends approach tangent to the horizontal input and output apertures of the buffer.

The buffer includes an inlet roller pair 56 at the inlet aperture 44 and defining a nip through which the media path passes. One of the rollers of this pair is operated by a motor 60 that is connected by an external connector 62 to the printer controller 34, so that the buffer inlet roller pair is slave-driven in synch with the printer output roller 30. In an alternative embodiment, this slave connection may be eliminated, and the buffer inlet rollers spaced apart until a sensor on the printer on in the buffer indicates that a sheet is clear of the printer rollers, so that the buffer inlet rollers may close, and rapidly advance the sheet into the buffer.

The buffer inlet path portion 50 is defined by a set of curved media guides 64, 66, which funnel a sheet on a path that bends downward toward the vertical. As the path reaches the vertical, the inlet and output paths 50, 52 join to form the vertical lower path portion 54. The output path portion 52 is defined by a set of guides 70, 72. Guides 64 and 70 approach each other at their lower ends to form a throat just above a pair of feed rollers 74, to guide sheets into the nip of these rollers (or between the rollers in embodiment where the rollers are spaced apart during inlet of a sheet.) The guides 66 and 72 form a point above the rollers 74, and a movable gate 76 extends from this point to admit a sheet to the rollers during inlet by swinging toward guide 70, and to permit reliable ejection of a sheet from the lower path portion by swinging to the left to position 70', guiding a vertically traveling sheet to the right and up the output path portion 52.

The lower path portion 54 terminates at a floor stop 80 positioned well below the rollers to accommodate sheet of maximum length. The distance 82 between the stop and the tip of the flap 76 is established to be at least slightly greater than the longest sheet that the buffer is intended to handle. In the preferred embodiment, the rollers 74 retain control of a sheet without dropping the sheet to the floor. However, in an alternative embodiment in which the rollers are open as a sheet is received and dropped to the floor, the distance between the floor and the nip of the rollers 74 is less than the minimum sheet length, to avoid a short sheet from being stranded out of reach of the rollers. Such an embodiment may employ an adjustable floor level to accommodate different sheet lengths.

The finishing device 16 is shown as a collator, although it may be any finishing device having an inlet aperture 84 registered with the outlet 46 of the buffer device. A similar mechanical connection assures this registration. The finishing device has a pair of inlet rollers 86, which may operate in response to triggering of a media edge sensor at the inlet, or may be electronically connected for slave driving by a controller in the buffer. The rollers 84 of the finishing device are a common element among all finishing devices, and operate at a continuous smooth velocity during operation, unlike the indexed operation of the printer feed mechanism.

The system operates by the printer generating an image on an upper surface of a sheet facing the ink jet pen 26. During printing, the sheet is fed in an indexed manner from the printer by rollers 30, and received in the buffer by rollers 56. Rollers 56 may be spaced apart at this time to avoid the need for slave control by the printer in the alternative discussed above. Printing proceeds while the leading edge of the sheet enters farther into the buffer device, proceeding partially down the path portion 54.

When printing of the sheet is completed, the sheet may continue to be advanced in the indexed manner as a next sheet is printed, until the trailing edge of the first sheet is clear of the printer output roller 30. In an alternative embodiment, the output roller may open in response a signal from a printer controller that printing of the first sheet is complete, and the feeding of the first sheet may then be taken over by the inlet rollers 56, at a speed and continuous manner not limited by the printing feed characteristics.

Once the first sheet is clear of feed control by the printer, it is rapidly processed by the buffer so that the buffer is readied to process the next sheet within an adequate interval. Clearance from the printer occurs either when the printer output roller 30 opens, or when the trailing edge of the sheet departs the roller. The sheet is then fed by the buffer input rollers 56 with the gate 76 in the inlet position shown in solid lines. The lower rollers 74 may either be held open to let the sheet drop onto the stop, or may be closed and rotating to controllably feed to sheet toward the stop. In the case of closed and moving rollers, a sensor 90 above the rollers serves to indicate when the leading edge of a sheet has arrived to trigger operation of the rollers, and when the trailing edge of a sheet has arrived, triggering the rollers to stop rotating. This stopping capability allows the system to be used with much shorter media such as index cards, which would otherwise be lost below the rollers 74.

In response to a signal from the sensor 90 that the trailing edge of the sheet has passed below the level of the tip of the gate 76, the gate is toggled to position 76', and output of the sheet may proceed. The rollers 74 reverse directions and advance the sheet up the output path portion 52 at a rapid rate provided by continuous rotation. Advancing continues until the now-leading edge of the sheet (formerly the trailing edge) exits the buffer device, and is received by the inlet rollers 86 of the finishing device. The finishing device wheels are set to operate at the same advance rate as the rollers 74 of the buffer, to avoid tugging or bunching of the sheet for the time that both roller sets are operating on the sheet. Alternatively, an electronic control connection between the buffer and the finisher may allow the buffer rollers 74 to open and release the sheet when the finisher indicates that the leading edge of the sheet is received and controlled by its rollers 86.

When the sensor 90 indicates that the trailing edge of the sheet has departed the rollers 74 of the buffer, the buffer may be readied for the next sheet. The gate 76 is returned to the right, the rollers 74 are either separated to receive the next sheet, stopped to be ready for rotation triggered by the sensor 90, or rotated in readiness for the next sheet, depending on which alternative mode of operation is selected. The inlet rollers 56 will have already been returned to a ready state after the trailing edge of the first sheet had passed, and the next sheet is presumably already being received by the inlet rollers.

One effect of the buffer apparatus is that a sheet that is received printed side up from the printer is inverted by the process of bending it downward as it is received, stopping and reversing its motion, and feeding it away on a different path as it is flexed in the opposite direction. The simple capability of this sheet inversion has an advantage for collation. It is helpful to have downward facing output, so that sheets may be printed in normal order, with the first printed sheet being page one of a document, and so on (with sheets printed in order and accumulated in a stack face up, the last sheet will be on the top, requiring reversal of the order.) Thus the buffer avoids the need to print sheets in reverse order.

Where it is desired to keep the sheet facing in the same direction, a second stop-and-reverse "dead end" element may be added in the buffer. This may be beside the illustrated path, as if two buffers were positioned side by side. For a more compact system, however, the paper path may depart the lower path portion 54, and continue straight up on a path 92 into another dead end 94 extending vertically upward from the lower dead end illustrated. A gate flap at the junction between the second dead end's inlet and output 96 leading to the buffer exit would control the intake and output of sheets in the same manner as in the first inlet While the above is discussed in terms of preferred and alternative embodiments, the invention is not intended to be so limited. For instance, the printer, buffer, and finisher need not be separate components attached together. The buffer may be part of the printer, or part of the finisher, or the entire system may be contained in a single unit.

What is claimed is:

1. A printing apparatus comprising:

an index-feeding printing system defining a first media path;

a continuous feed finishing apparatus defining a second media path;

a media buffer device defining a third media path that includes part of the first media path and part of the second media path and that connects those parts of the first media path and the second media path; and wherein the third media path terminates in an irrotational stop against which is halted movement of media in the connected part of the first media path, the position of the stop being adjustable along the third media path.

2. The apparatus of claim 1 including a pair of rollers that are movable into and out of a transport position defining a nip through which may pass media moving along the third media path, there being no nip present when the rollers are out of the transport position.

3. The apparatus of claim 2 wherein the rollers are mounted in the third media path at a predetermined distance from the stop.

4. The apparatus of claim 2 including a sensor for sensing movement of media in the third media path and for providing a signal for moving the rollers into and out of the transport position.

5. The apparatus of claim 2 being configured for moving through the media buffer device a sheet of media having a given length and wherein the distance between the rollers and the stop is selected to be less than the given length.

6. A method of transporting media comprising:

receiving a media sheet from a printing apparatus in incremental feed steps interrupted by pauses;

moving the sheet between two spaced apart rollers that are adjacent to a path of the moving sheet;

locating a stop member away from the rollers;

adjusting the location of the stop member in relation to the given length of the media sheet;

stopping the sheet by blocking an edge of the sheet with the stop;

moving the rollers together to form a nip; and outputting the sheet to a finishing apparatus by advancing the sheet through the nip.

7. The method of claim 6 wherein receiving the media sheet includes receiving the sheet in incremental feed steps interrupted by pauses, and wherein outputting the sheet includes moving the sheet with a continuous motion uninterrupted by pauses.

8. The method of claim 6 wherein receiving the media sheet includes receiving the sheet with a first face of the sheet facing in a first direction, and wherein outputting the sheet includes outputting the sheet with the first face in a second direction opposite the first direction.

9. The method of claim 6 wherein receiving the media sheet includes flexing the sheet to direct it toward the path terminus, and wherein outputting the sheet includes flexing the sheet to direct it to the finishing apparatus.

10. A printing apparatus comprising:

an index-feeding printing system defining a first media path;

a continuous feed finishing apparatus defining a second media path;

a media buffer device defining a third media path that includes part of the first media path and part of the second media path and that connects those parts of the first media path and the second media path, the apparatus being configured for moving through the media buffer device a sheet of media having a given length;

wherein the third media path terminates in an irrotational stop against which is halted movement of media in the connected part of the first media path; and a movable gate mounted in the third media path for separating the first and second media paths, the gate being located at a distance from the stop that is greater than the given length of the media sheet.

11. The apparatus of claim 10 including a pair of movable rollers mounted in the third media path to be movable into and out of a transport position that defines a nip through which may pass media moving along the third media path.

12. The apparatus of claim 10 wherein the position of the stop is adjustable along the third media path.

* * * * *